US006467765B2

(12) United States Patent
Yukimachi

(10) Patent No.: US 6,467,765 B2
(45) Date of Patent: Oct. 22, 2002

(54) SHEET FEEDING APPARATUS AND IMAGE FORMING APPARATUS HAVING SAME

(75) Inventor: Hiroshi Yukimachi, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 75 days.

(21) Appl. No.: 09/770,249

(22) Filed: Jan. 29, 2001

(65) Prior Publication Data

US 2001/0010414 A1 Aug. 2, 2001

(30) Foreign Application Priority Data

Feb. 2, 2000 (JP) ..... 2000-025709

(51) Int. Cl.[7] ..... B65H 3/44
(52) U.S. Cl. ..... 271/9.11; 271/117
(58) Field of Search ..... 271/9.11, 117, 271/118

(56) References Cited

U.S. PATENT DOCUMENTS 2,679,801 A * 6/1954 Ford et al. ..... 271/117
5,383,655 A * 1/1995 Hayakawa et al. ..... 271/117
5,501,444 A 3/1996 Yukimachi et al. ..... 271/127
5,868,385 A * 2/1999 Embry et al. ..... 271/118
6,024,356 A * 2/2000 Tanaka et al. ..... 271/118

FOREIGN PATENT DOCUMENTS

JP 61-81338 A * 4/1986 ..... 271/117

* cited by examiner

*Primary Examiner*—H. Grant Skaggs
(74) *Attorney, Agent, or Firm*—Fitzpatrick, Cella, Harper & Scinto

(57) ABSTRACT

The present invention provides a sheet feeding apparatus that has sheet feeding device for abutting against an upper surface of a sheet stacked and feeding out the sheet, biasing device for biasing the sheet feeding device toward the upper surface of the sheet, and lifting and lowering device for lifting and lowering the sheet feeding device, the lifting and lowering device including a holding member for engaging with the sheet feeding device and shifting the sheet feeding device in an up-and-down direction by a motor, and maintaining device for regulating the holding member so as to maintain the sheet feeding device at a position where the sheet feeding device is spaced apart from the upper surface of the sheet, in opposition to a biasing force of the biasing device.

11 Claims, 10 Drawing Sheets

SHEET FEEDING APPARATUS AND IMAGE FORMING APPARATUS HAVING SAME

BACKGROUND OF THE INVENTION

1. Field of the Invention

The present invention relates to a sheet feeding apparatus and an image forming apparatus having such a sheet feeding apparatus, and more particularly, it relates to a sheet feeding apparatus in which a sheet is fed out by sheet feeding means provided above the sheet for lifting and lowering movements.

2. Related Background Art

In some of conventional image forming apparatuses such as printers, copying machines and the like, there is provided a sheet feeding apparatus in which a sheet is fed to an image forming portion by sheet feeding means such as a pick-up roller. Among such sheet feeding apparatuses, there is a sheet feeding apparatus in which the sheet feeding means is provided above the sheet for lifting and lowering movements in such a manner that, when the sheet is fed, the sheet feeding means is lowered to be urged against the sheet and, in this condition, the sheet is fed out by rotating the sheet feeding means, and, thereafter, the sheet feeding means is lifted to be separated from the sheet.

By the way, in such a sheet feeding apparatus, although means for lifting and lowering the sheet feeding means was generally comprised of a solenoid or a cam one revolution of which is controlled, recently, as the speed of the printer has been increased, it is required that the sheet feeding means be urged against the sheet at higher speed and also be separated from the sheet at higher speed after the feeding of the sheet. Further, as noise of recent printers has been reduced, it is required for avoiding usage of an actuator such as a solenoid generating great noise.

To this end, there has been proposed a sheet feeding apparatus in which, as the means for lifting and lowering the sheet feeding means, a lifting and lowering mechanism for directly lifting and lowering the sheet feeding means by using a pulse motor, for example, is provided.

FIG. 8 shows a construction of such a conventional sheet feeding apparatus using a pulse motor. In FIG. 8, the sheet feeding apparatus comprises pick-up rollers 1*a*, 1*b* as sheet feeding means provided for lifting and lowering movements, and rotations of the pick-up rollers around shafts 2*a*, 2*b* are controlled by drive sources (not shown). Further, the pick-up rollers 1*a*, 1*b* are rotatably held on ends of roller holders 3*a*, 3*b* which are held by an image forming apparatus (not shown) for rotations around shafts 4*a*, 4*b*.

Incidentally, there are provided roller springs 5*a*, 5*b* as urging means for biasing the pick-up rollers 1*a*, 1*b* in anti-clockwise directions (along which the rollers are urged against an upper surface of a stached sheet P) via the roller holders 3*a*, 3*b* so that the pick-up rollers 1*a*, 1*b* are urged against the sheet (not shown) with predetermined pressure by biasing the pickup rollers 1*a*, 1*b* in the anti-clockwise directions by means of the roller springs 5*a*, 5*b*.

Further, in FIG. 8, the reference numeral 6 denotes a rod as a holding member capable of moving in an up-and-down direction and adapted to hold the pick-up rollers 1*a*, 1*b* for lifting and lowering movements, and "M" denotes a pulse motor as a reversible motor. Rotation of the pulse motor M is transmitted to the rod 6 via a motor gear 12, a first drive transmitting gear 11 as a first transmitting gear meshed with the motor gear 12, a second drive transmitting gear 13 as a second transmitting gear integrally formed with the first drive transmitting gear 11, and a rack gear 10 meshed with the second drive transmitting gear 13 and provided on one side of the rod 6. Incidentally, the first and second drive transmitting gears 11, 13 are rotatably held on a rotary shaft 17.

On the other hand, guide holes 6*c* extending in an up-and-down direction are formed in upper and lower portions of the rod 6, so that, when the rotation of the pulse motor M is transmitted via the gear train comprised of the motor gear 12, first and second drive transmitting gears 11, 13 and rack gear 10, the rod 6 is shifted in the up-and-down direction while being guided by pins 7, 8 inserted in the guide holes 6*c*.

Incidentally, support portions 6*a*, 6*b* for supporting the shafts 2*a*, 2*b* of the pick-up rollers 1*a*, 1*b* from below are protruded horizontally from lower and upper ends of the rod 6. With this arrangement, when the rod 6 is shifted in the up-and-down direction, the pick-up rollers 1*a*, 1*b* are shifted in the up-and-down direction by the aid of the spring forces of the roller springs 5*a*, 5*b* or in opposition to the spring forces as the rod 6 is shifted.

Next, a sheet feeding operation of the sheet feeding apparatus having the above-mentioned construction will be explained.

In a waiting condition of the sheet feeding apparatus before it starts the sheet feeding operation, the rod 6 is held at a highest position or home position, so that the pick-up rollers 1*a*, 1*b* are positioned above the sheet. In this case, although the pulse motor M is not rotated, it is maintained in an exciting condition so that the rod 6 is held in the home position in opposition to the biasing forces of the roller springs 5*a*, 5*b*.

On the other hand, when sheet feeding command is emitted from a controlling device (not shown) provided in the image forming apparatus, first of all, the pulse motor M is rotated in the anti-clockwise direction, and the anti-clockwise rotation is transmitted to the rod 6 via the motor gear 12, first and second drive transmitting gears 11, 13 and rack gear 10, with the result that the rod 6 is lowered. When the rod 6 is lowered in this way, the pick-up rollers 1*a*, 1*b* are also lowered together with the rod 6 by the biasing forces of the roller springs 5*a*, 5*b*, thereby urging the pick-up rollers against the sheet P.

Incidentally, even after the pick-up rollers 1*a*, 1*b* are urged against the sheet in this way, the rod 6 is further lowered by a predetermined distance. Here, when the rod 6 is lowered in this way, since the pick-up rollers 1*a*, 1*b* abut against the sheet, the support portions 6*a*, 6*b* of the rod 6 are separated from the shafts 2*a*, 2*b* of the pick-up rollers 1*a*, 1*b*. As a result, the pick-up rollers 1*a*, 1*b* are urged against the sheet P with predetermined abut pressure by the biasing forces of the roller springs 5*a*, 5*b*.

After the pick-up rollers 1*a*, 1*b* are urged against the sheet P in this way, by rotating the pick-up rollers 1*a*, 1*b*, the sheet P can be fed to the image forming portion (not shown).

On the other hand, when the sheet feeding operation is finished, the pulse motor M is rotated in a clockwise direction, with the result that the rod 6 is lifted and the support portions 6*a*, 6*b* abut against the shafts 2*a*, 2*b* of the pick-up rollers 1*a*, 1*b* from below. Further, thereafter, when the rod 6 is lifted, the pick-up rollers 1*a*, 1*b* are lifted together with the rod 6 in opposition to the biasing forces of the roller springs 5*a*, 5*b*, thereby separating the pick-up rollers from the sheet P. Thereafter, the rod 6 is returned to the home position. In this case, by bringing the pulse motor M to the exciting condition, the rod 6 is held at the home position in opposition to the biasing forces of the roller springs 5*a*, 5*b*.

By the way, the during such a sheet feeding operation, since the pick-up rollers 1*a*, 1*b* are biased so that they generally abut against the sheet P with load in the order of about 0.5 N to about 3 N, when the above-mentioned sheet feeding operation is effected, torque acting on the pulse motor M is changed as shown in FIG. 9. Incidentally, in FIG. 9, the ordinate indicates the position of the rod 6 and the abscissa indicates torque acting on the motor shaft of the pulse motor M.

As apparent from FIG. 9, when the rod 6 is in the home position, maximum torque $T_{max}$ acts on the pulse motor M to hold the rod 6 in the home position. Further, at the time when the pick-up rollers 1*a*, 1*b* are contacted with the sheet, although the torque is instantaneously decreased by an amount corresponding to the roller pressure, even in a condition HL that the rod 6 is lowered at the maximum extent, torque $T_{min}$ corresponding to the weight of the rod 6 itself acts on the pulse motor M.

Accordingly, in the conventional sheet feeding apparatus using such a pulse motor M, the electrical power is required even in the waiting condition, and, since the maximum torque is great, a large torque motor is required, which is very disadvantageous in consideration of the power consumption.

On the other hand, proper backlash is provided between the first drive transmitting gear 11 and the motor gear 12. Further, as shown in FIG. 10, proper backlash B is also provided between the second drive transmitting gear 13 and the rack gear 10 of the rod 6.

However, in the conventional sheet feeding apparatus having the lifting and lowering means including such a pulse motor M and the gear train for transmitting the rotation of the pulse motor M to the rod 6, since the pulse motor M must quickly be started and stopped reversibly and slow-up and slow-down control is effected on demand, due to the backlash B in the gears 10 to 13, great discordant slapping noise is generated in meshed portions in the gear train, which makes reduction of noise difficult or impossible.

SUMMARY OF THE INVENTION

The present invention is made in consideration of the above-mentioned circumstances, and an object of the present invention is to provide a sheet feeding apparatus which can reduce power consumption and noise, and an image forming apparatus having such a sheet feeding apparatus.

To achieve the above object, the present invention provides a sheet feeding apparatus comprising sheet feeding means for abutting against an upper surface of a sheet stacked and feeding out the sheet, biasing means for biasing the sheet feeding means toward the upper surface of the sheet stack, and lifting and lowering means for lifting and lowering the sheet feeding means, wherein the lifting and lowering means comprises a holding member for engaging with the sheet feeding means and shifting the sheet feeding means in an up-and-down direction by a motor, and maintaining means for regulating the holding member so as to maintain the sheet feeding means at a position where the sheet feeding means is spaced apart from the upper surface of the sheet, in opposition to a biasing force of the biasing means.

DESCRIPTION OF THE PREFERRED EMBODIMENTS

The present invention will now be explained in connection with embodiments thereof with reference to the accompanying drawings.

Figure 1:
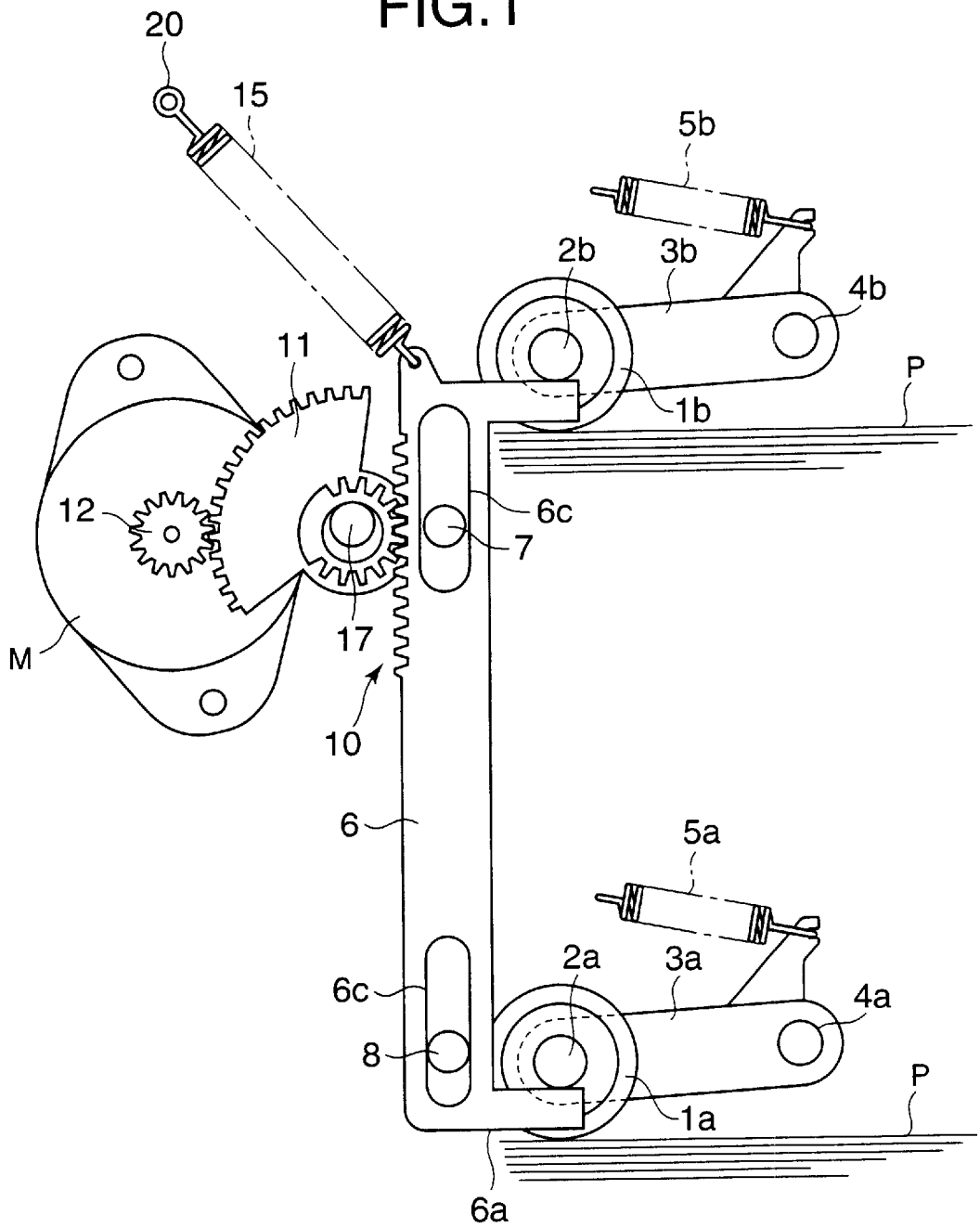
FIG. 1 is a view showing a construction of a sheet feeding apparatus according to a first embodiment of the present invention.
Figure 8:
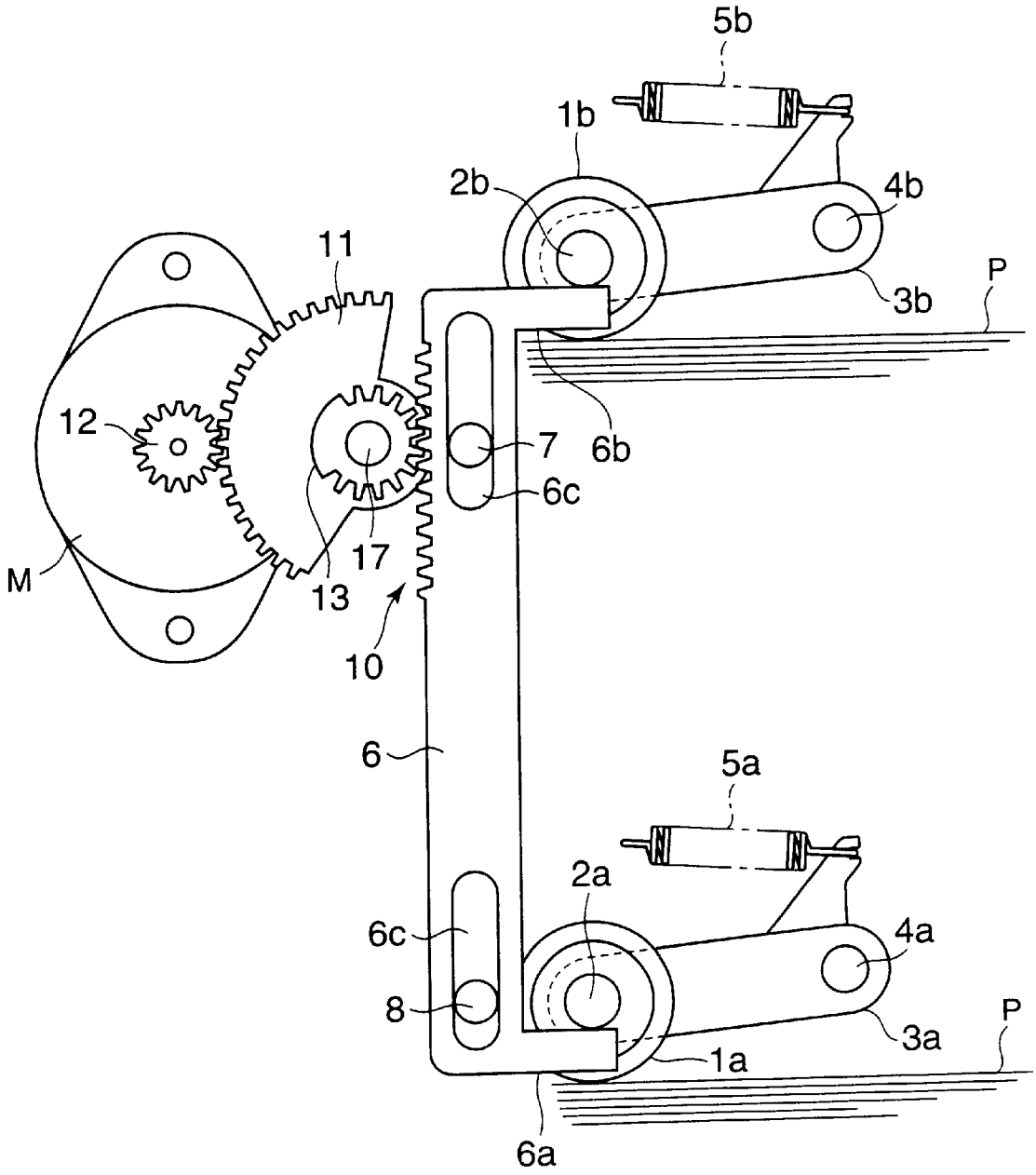
FIG. 8 is a view showing a construction of a conventional sheet feeding apparatus.

FIG. 1 is a view showing a construction of a sheet feeding apparatus according to a first embodiment of the present invention. Incidentally, in FIG. 1, the same elements as those shown in FIG. 8 are designated by the same reference numerals.

Pick-up rollers 1*a*, 1*b* as sheet feeding means are disposed above sheet supporting means such as a sheet cassette or a deck (not shown) for supporting sheets P (not shown), for lifting and lowering movements.

A rod spring 15 as biasing means constituting maintaining means (described later) has one end locked to an upper end of a rod 6 as a holding means and the other end locked to a support portion 20 provided on an image forming apparatus (not shown). The rod 6 is biased by the rod spring 15 obliquely upwardly toward a first drive transmitting gear.

Figure 2:
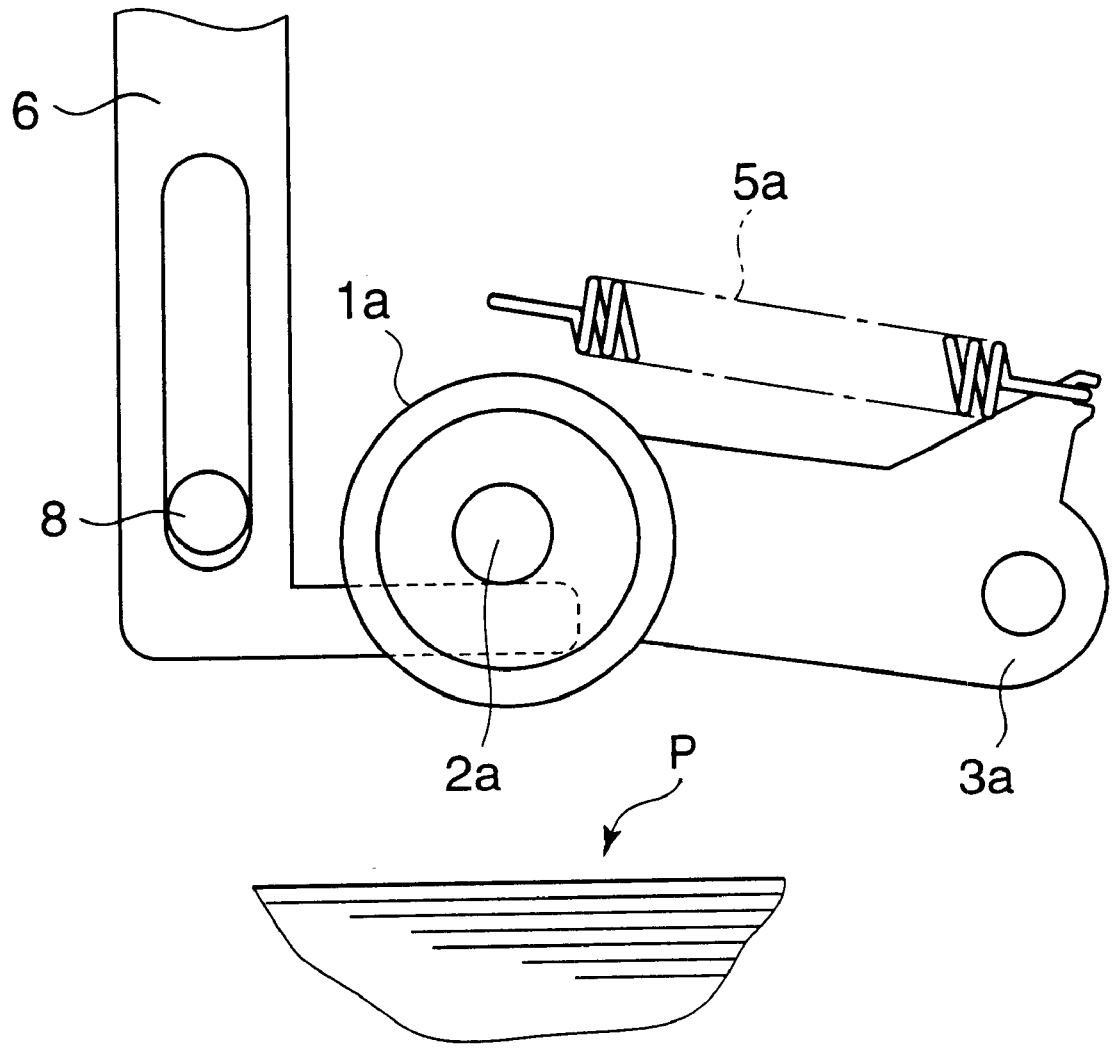
FIG. 2 is an enlarged view showing main portions of the sheet feeding apparatus in a waiting condition.

In a waiting condition of the sheet feeding apparatus before a sheet feeding operation is started, a spring force of the rod spring 15 is selected so that a pulling force (tensility) of the rod spring 15 is balanced with biasing forces of roller springs 5*a*, 5*b* when the rod 6 is in a highest position or home position as shown in FIG. 2. Incidentally, elastic forces of the springs are selected so that resulting biasing force of the roller springs 5*a*, 5*b* for lowering the rod 6 becomes equal to or slightly smaller than the biasing force of the rod spring 15 or lifting the rod 6 upwardly.

By setting the spring force of the rod spring 15 in this way, the rod spring 15 acts as maintaining means for canceling the biasing forces (abutting forces) of the roller springs 5*a*, 5*b* acting on the rod 6 via shafts 2*a*, 2*b* of the pick-up rollers 1*a*, 1*b*, so that torque is prevented from acting on a pulse motor M via a gear train comprised of a rack gear 10, second drive transmitting gear 13, first drive transmitting gear 11 and motor gear 12. As a result, in the waiting condition, it is not required that the pulse motor M be maintained in an exciting condition.

Figure 3:
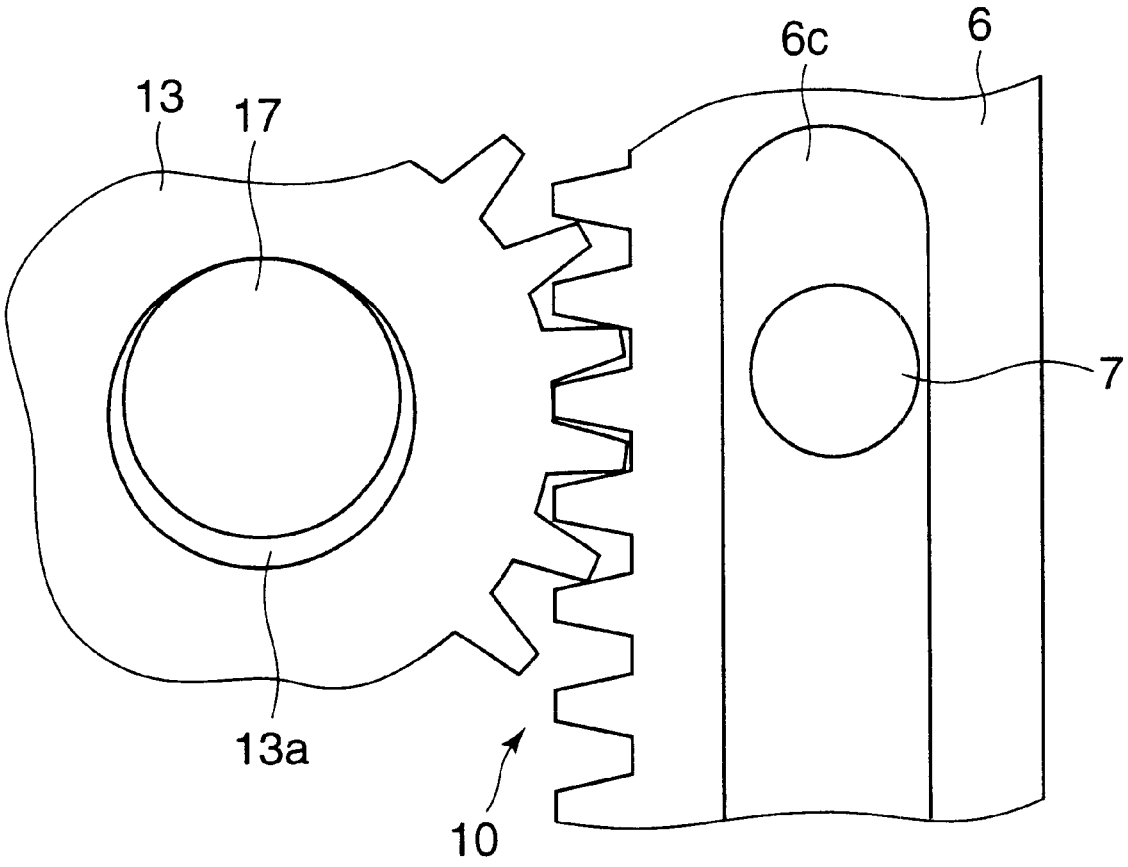
FIG. 3 is an enlarged view showing a rack gear of a rod and a second drive transmitting gear in the sheet feeding apparatus.

FIG. 3 is an enlarged view showing the rack gear 10 and the second drive transmitting gear 13. As shown in FIG. 3, a guide hole 6*c* provided in an upper portion of the rod 6 has a dimension greater than that of a pin 7. Further, a shaft hole 13*a* of the second drive transmitting gear 13 and a shaft hole (not shown) of the first drive transmitting gear 11 has also dimensions greater than an outer diameter of a shaft 17.

By forming the guide hole 6*c* of the rod 6 and the shaft holes 13*a* of the first and second drive transmitting gears 13, play is generated in the rod 6 and the first and second drive transmitting gears 13. With this arrangement, during the sheet feeding operation which will be described later, by the pulling force (urging force) of the rod spring 15 acting on the rod 6 as urging means directed toward the first and second drive transmitting gears, as shown in FIG. 3, the rack gear 10 and the second drive transmitting gear 13 are brought to a non-backlash condition. Incidentally, by having arrangement in this way, although not shown, a non-backlash condition is established between the first drive transmitting gear 11 and the motor gear 12.

Next, a sheet feeding operation of the sheet feeding apparatus having the above-mentioned construction will be explained.

In the waiting condition of the sheet feeding apparatus before it starts the sheet feeding operation, the rod 6 is held at the highest position or home position, so that the pick-up rollers 1*a*, 1*b* are positioned above the sheet P. When the rod 6 is in the home position, since the pulling force of the rod spring 15 is balanced with the biasing forces of the roller springs 5*a*, 5*b*, it is not required that the pulse motor M be maintained to the exciting condition.

On the other hand, when sheet feeding command is emitted from a controlling device (not shown) provided in the image forming apparatus, first of all, the pulse motor M is rotated in an anti-clockwise direction, and the anti-clockwise rotation is transmitted to the rod 6 via the motor gear 12, first and second drive transmitting gears 11, 13 and rack gear 10, with the result that the rod 6 is lowered. When the rod 6 is lowered in this way, the pick-up rollers 1*a*, 1*b* are also lowered together with the rod 6 by the biasing forces of the roller springs 5*a*, 5*b*, thereby urging the pick-up rollers against the sheet P.

Figure 4:
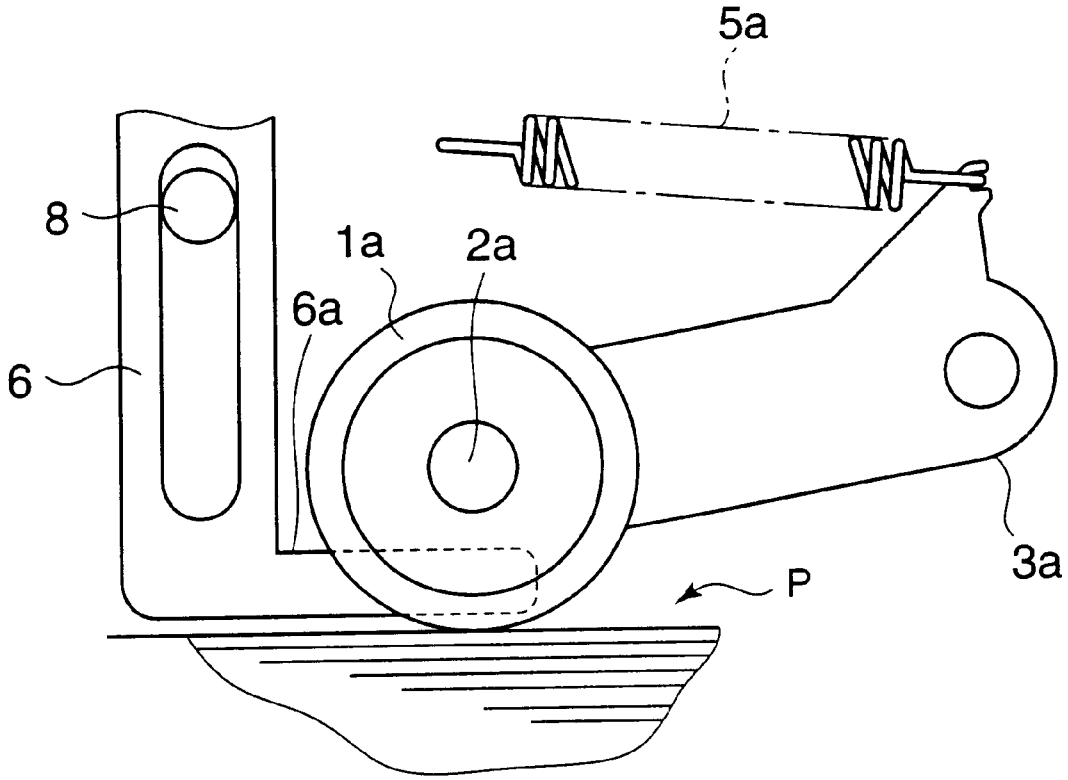
FIG. 4 is an enlarged view showing main portions of the sheet feeding apparatus in a sheet feeding condition.

Incidentally, even after the pick-up rollers 1*a*, 1*b* are urged against the sheet P in this way, the rod 6 is further lowered by a predetermined distance. Here, when the rod 6 is lowered in this way, since the pick-up rollers 1*a*, 1*b* abut against the sheet P, support portions 6*a*, 6*b* of the rod 6 are separated from the shafts 2*a*, 2*b* of the pick-up rollers 1*a*, 1*b*, as shown in FIG. 4. As a result, the pick-up rollers 1*a*, 1*b* are urged against the sheet P with predetermined abut pressure by the biasing forces of the roller springs 5*a*, 5*b*.

When the rod 6 is lowered in this way, since the biasing forces of the roller springs 5*a*, 5*b* does not act on the rod 6, only the spring force of the rod spring 15 acts on the rod 6, thereby pulling the rod 6 upwardly.

In order to hold the rod 6 pulled upwardly in a position shown in FIG. 4, the pulse motor M is excited while being stopped, until the sheet feeding operation is completed. As a result, the rod 6 is held and the pick-up rollers 1*a*, 1*b* are urged against the sheet P positively with predetermined pressure. And, one of the upper and lower pick-up rollers 1*a*, 1*b* is selectively driven by a driving force from a drive source (not shown), thereby feeding out the sheet P.

After the pick-up rollers 1*a*, 1*b* are urged against the sheet P in this way, by rotating the pick-up rollers 1*a*, 1*b*, the sheet P can be fed to an image forming portion (not shown).

On the other hand, when the sheet feeding operation is finished, the pulse motor M is rotated in a clockwise direction, with the result that the rod 6 is lifted and the support portions 6*a*, 6*b* abut against the shafts 2*a*, 2*b* of the pick-up rollers 1*a*, 1*b* from below. Further, thereafter, when the rod 6 is lifted, the pick-up rollers 1*a*, 1*b* are lifted together with the rod 6 in opposition to the biasing forces of the roller springs 5*a*, 5*b*, thereby separating the pick-up rollers from the sheet P.

Thereafter, the rod 6 is returned to the home position again. Incidentally, in this case, since the pulling force of the rod spring 15 is balanced with the biasing forces of the roller springs 5*a*, 5*b*, it is not required that the pulse motor M be maintained to the exciting condition.

By the way, during the above-mentioned sheet feeding operation, as shown in FIG. 3, the rack gear 10 and the second drive transmitting gear 13 become a non-backlash condition by the pulling force of the rod spring 15 tending to pull the rod 6 toward the first and second drive transmitting gears. Further, a non-backlash condition is also established between the first drive transmitting gear 11 and the motor gear 12.

By establishing the non-backlash conditions between the gears, slapping noise due to vibration generated every phase angle of the pulse motor M is not generated between the gears, with the result that the pick-up rollers 1*a*, 1*b* can be lifted and lowered silently.

Figure 5:
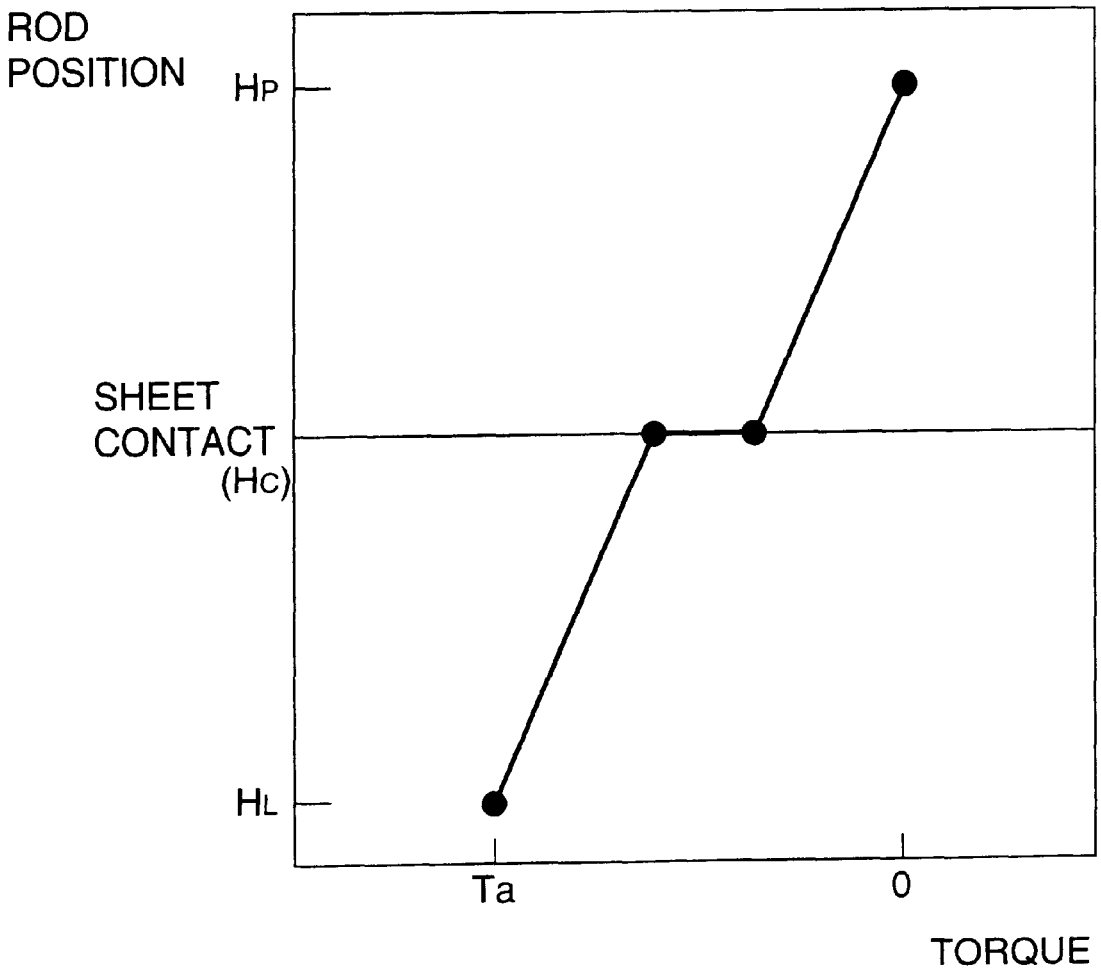
FIG. 5 is a view showing a relationship a position of the rod and torque acting on a pulse motor in the sheet feeding apparatus.

FIG. 5 shows change in torque acting on the pulse motor M during the sheet feeding operation. Incidentally, in FIG. 5, the ordinate indicates a position of the rod 6 and the abscissa indicates torque acting on a motor shaft of the pulse motor M.

Figure 9:
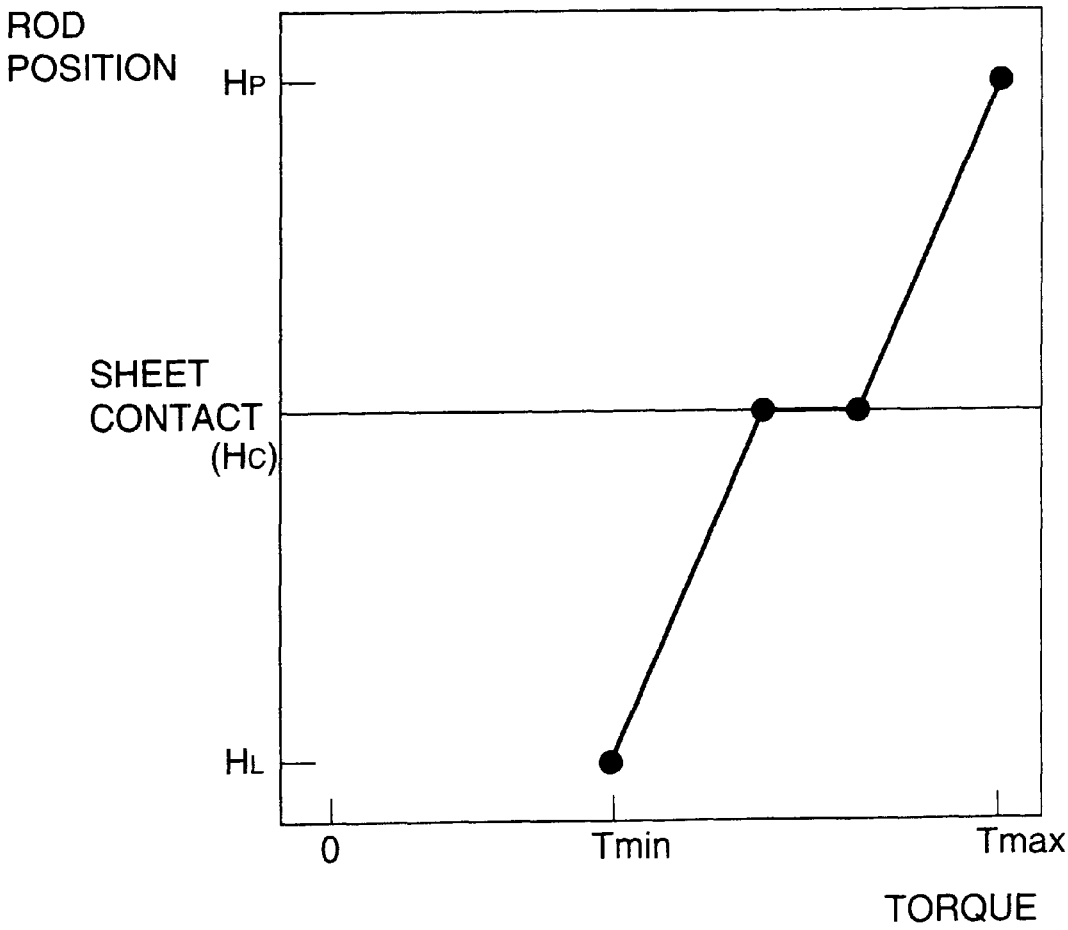
FIG. 9 is a view showing a relationship a position of the rod and torque acting on a pulse motor in the conventional sheet feeding apparatus.
Figure 10:
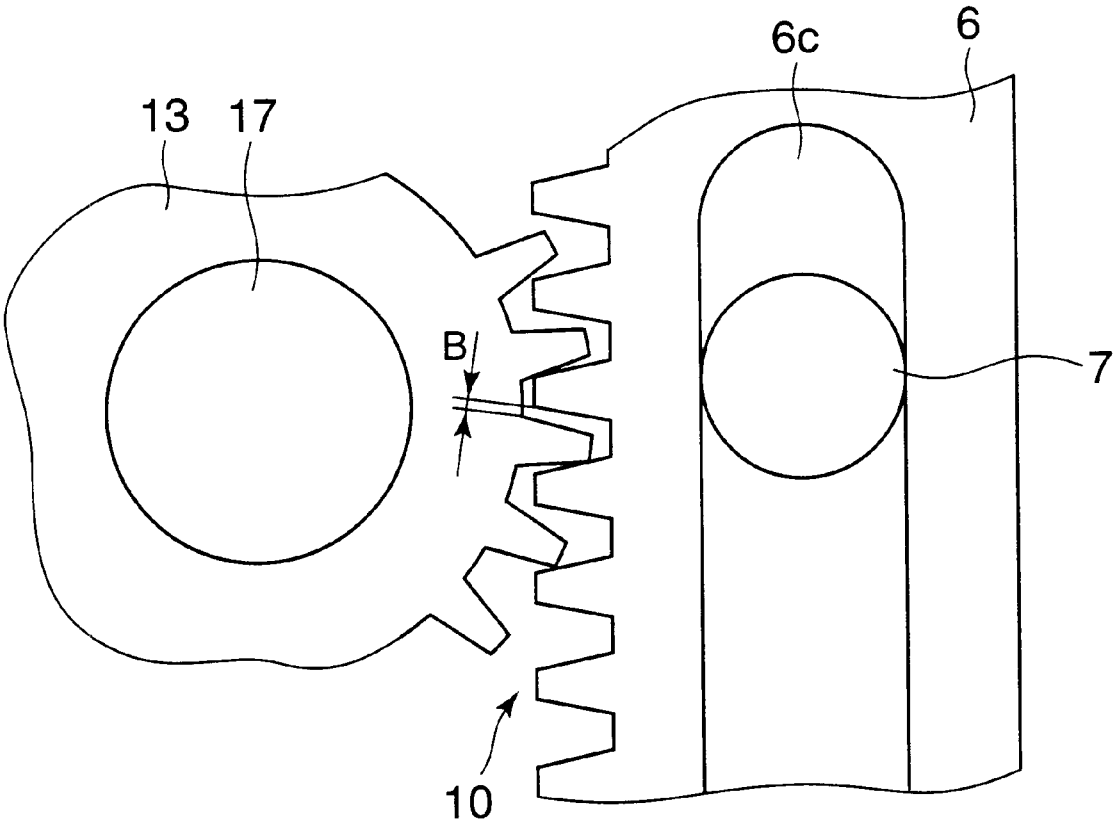
FIG. 10 is an enlarged view showing a rack gear of a rod and a second drive transmitting gear in the conventional sheet feeding apparatus.

In this case, although a configuration of the change in torque becomes similar to the configuration shown in FIG. 9, in the illustrated embodiment, as apparent from FIG. 5, since the rod spring 15 and the roller springs 5*a*, 5*b* are balanced with each other when the rod 6 is in the home position, the torque becomes zero.

Further, although minimize torque Ta, is generated in a condition HL that the rod 6 is lowered at the maximum extent, an absolute value of the value thereof becomes greatly smaller than that of the torque $T_{max}$ explained in connection with the prior art. Further, the motor is excited only during the sheet feeding operation.

In this way, by balancing the rod spring 15 with the roller springs 5*a*, 5*b* when the rod 6 is in the home position, i.e., by canceling the biasing forces (abut forces) of the roller springs 5*a*, 5*b* acting on the rod 6, the pulse motor M can be excited only during the sheet feeding operation. As a result, since any electric current is not required in the waiting condition, power consumption can be minimized. Further, since the torque can be reduced by pulling the rod 6 by means of the rod spring 15, a more compact motor having lower electric current can be used, thereby minimizing the power consumption.

Next, a second embodiment of the present invention will be explained.

Figure 6:
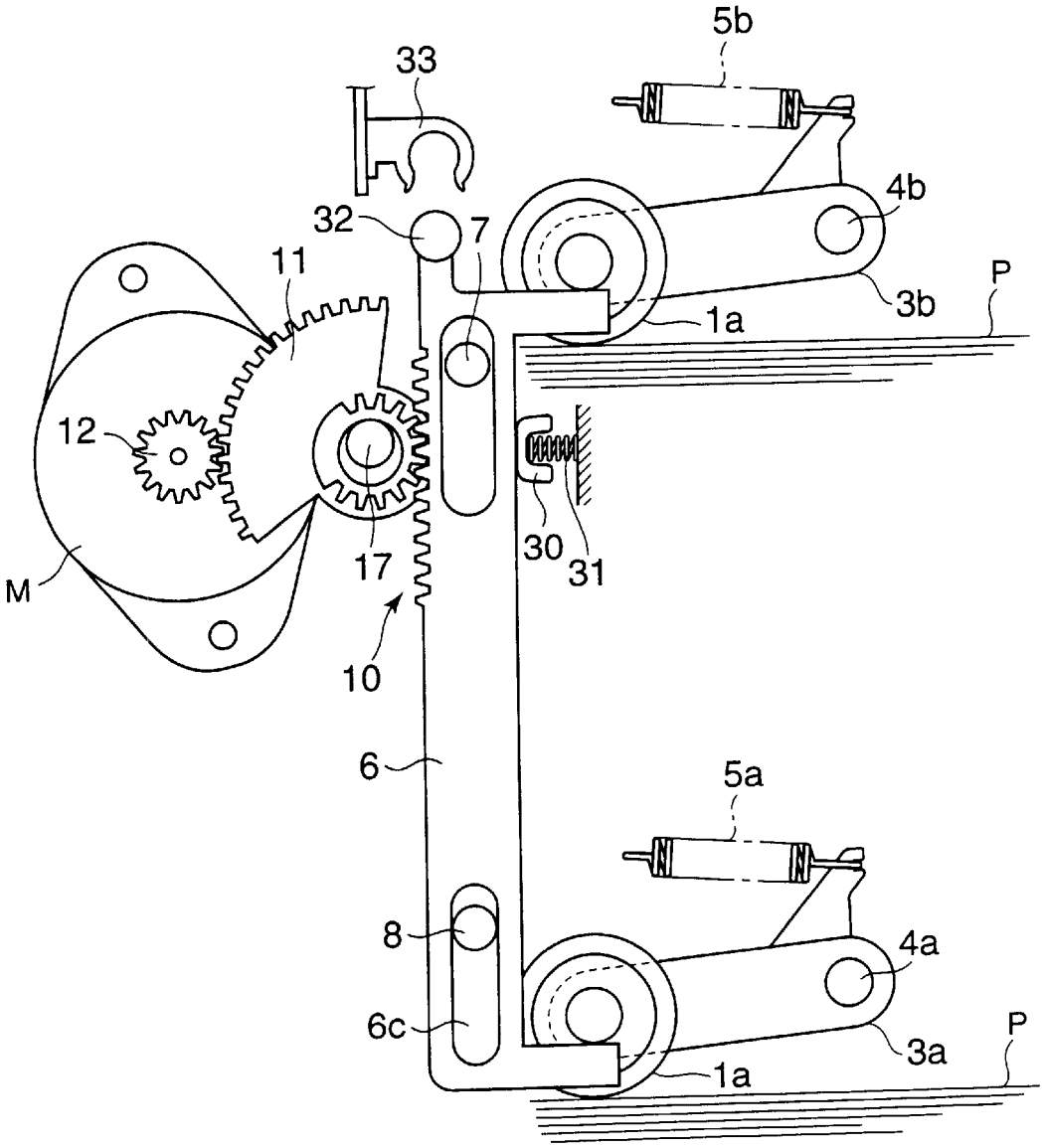
FIG. 6 is a view showing a construction of a sheet feeding apparatus according to a second embodiment of the present invention.

FIG. 6 shows a construction of a sheet feeding apparatus according to a second embodiment of the present invention. Incidentally, in FIG. 6, the same elements as those shown in FIG. 1 are designated by the same reference numerals.

In FIG. 6, the sheet feeding apparatus includes a pad 30 abutting against a side of a rod 6 opposite to a side where a rack gear 10 is formed, and a spring 31 for urging the pad 30 against the rod 6. By using the rod 6 toward first and second drive transmitting gears by means of urging means constituted by the spring 31 and the pad 30, backlash between the rack gear 10 and the second drive transmitting gear 13 and backlash between the first drive transmitting gear 11 and the motor gear 12 can be eliminated.

Figure 7:
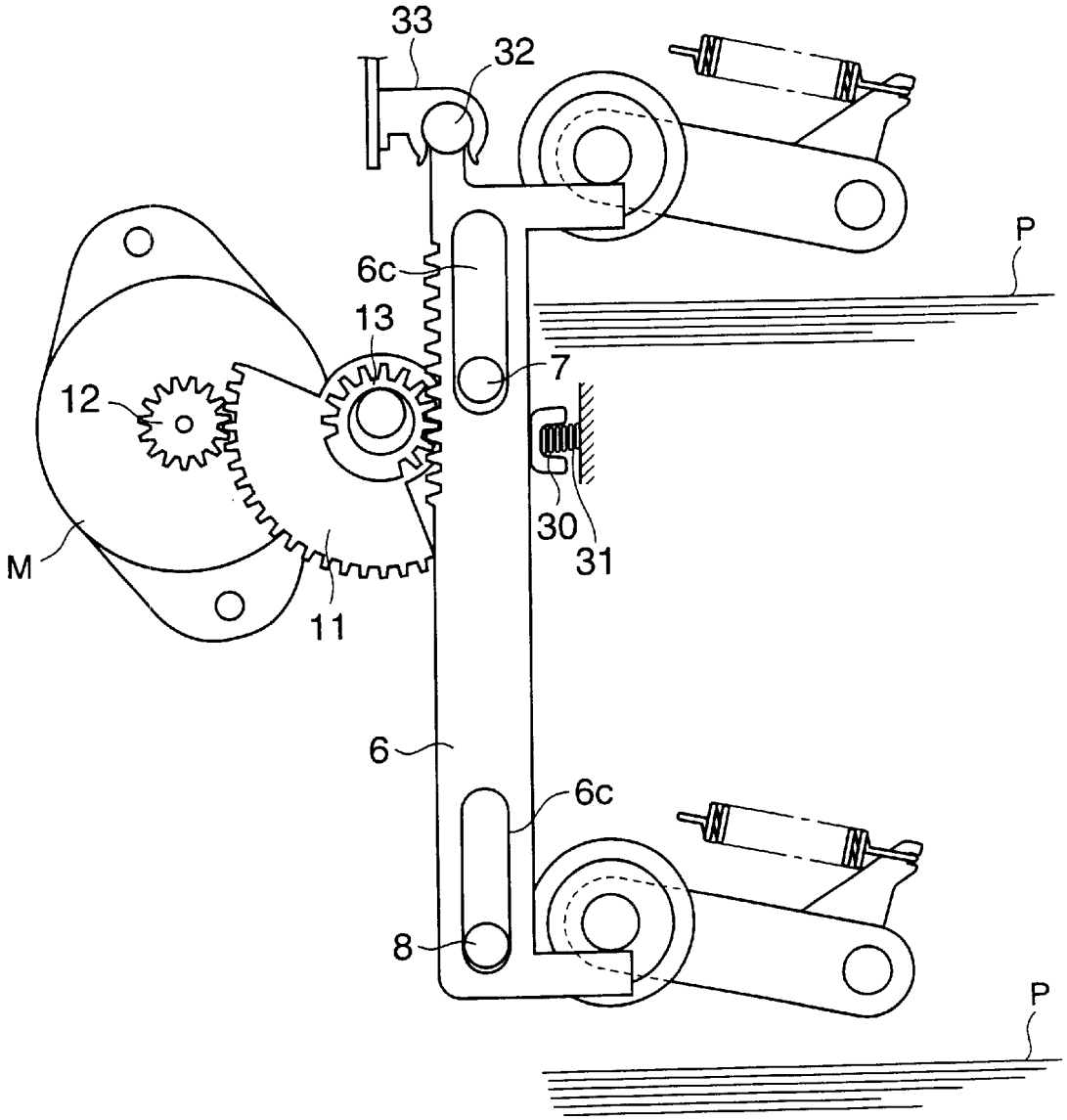
FIG. 7 is a view showing the sheet feeding apparatus in a waiting condition.

Now, maintaining means for maintaining the rod in an upper position will be described. In FIG. 6, a spherical member 32 is protruded from a distal end of the rod 6, and an engagement portion 33 is provided in a main body of an image forming apparatus (not shown) and serves to elastically engage by the spherical member 32 of the rod 6 when the rod 6 is in the home position. Maintaining means is constituted by the spherical member 32 and the engagement portion 33. When the rod 6 is lifted from a lowered condition shown in FIG. 6 to the home position as shown in FIG. 7 by the rotation of the pulse motor M, as shown in FIG. 7, the engagement portion 33 is elastically engaged by the spherical member 32, with the result that the rod 6 is held by the main body of the image forming apparatus via the engagement portion 33. Incidentally, an engagement force (holding force) of the engagement portion 33 is set to a level which can be released by the driving force of the pulse motor M.

When the rod 6 is lifted up to the home position in this way, by engaging the spherical member 32 of the rod 6 by the engagement portion 33, the biasing forces of the roller springs 5*a*, 5*b* acting on the rod 6 can be canceled. That is to say, by canceling the biasing forces (abutting forces) of the roller springs 5*a*, 5*b* acting on the rod 6 by means of the maintaining means comprised of the engagement portion 33 and the spherical member 32 of the rod 6, the pulse motor M can be excited only during the sheet feeding operation. As a result, since any electric current is not required in the waiting condition, the power consumption can be minimized.

Incidentally, in the illustrated embodiment, while an example that the engagement portion 33 has a circular snap-fit configuration was explained, the present invention is not limited to such an example, but, the engagement portion may be of any type so long as it can engageably hold the rod 6, and, for example, the engagement portion may hold the rod 6 magnetically.

What is claimed is:

1. A sheet feeding apparatus comprising:

sheet feeding means for abutting against an upper surface of a sheet stacked and feeding out the sheet;

biasing means for biasing said sheet feeding means toward the upper surface of the sheet; and lifting and lowering means for lifting and lowering said sheet feeding means;

said lifting and lowering means including a holding member for engaging with said sheet feeding means and shifting said sheet feeding means in an up-and-down direction by a motor, and maintaining means for regulating said holding member so as to maintain said sheet feeding means at a position where said sheet feeding means is spaced apart from the upper surface of the sheet, in opposition to a biasing force of said biasing means.

2. A sheet feeding apparatus according to claim 1, wherein said biasing means is a spring for biasing said sheet feeding means downwardly so as to urge said sheet feeding means against the upper surface of the sheet stacked, and said maintaining means is a spring for biasing said holding member upwardly so as to separate said sheet feeding means from the upper surface of the sheet.

3. A sheet feeding apparatus according to claim 2, wherein a biasing force of said spring for biasing said sheet feeding means to be separated from the sheet is set greater than a biasing force of said spring of said biasing means for biasing said sheet feeding means against the upper surface of the sheet.

4. A sheet feeding apparatus according to claim 1, wherein said maintaining means is engaging means for regulating movement of said holding member by engaging with said holding member in opposition to the biasing force of said biasing means in a condition that said sheet feeding means is separated from the upper surface of the sheet by said holding member.

5. A sheet feeding apparatus according to claim 4, wherein said engaging means includes a spherical member provided on said holding member, and an engagement portion for regulating the movement of said holding member by fitting in said spherical member in the condition that said sheet feeding means is separated from the upper surface of the sheet by said holding member.

6. A sheet feeding apparatus according to claim 1, further comprising a plurality of sheet supporting means for supporting the sheet in the up-and-down direction, wherein said sheet feeding means are arranged above the respective sheet supporting means, and said sheet feeding means is biased toward upper surface of the sheet supported by said sheet supporting members by said biasing means, said holding member provided shiftable in the up-and-down direction is provided with engagement portions for engaging with the respective sheet feeding means, so that said holding member is shifted upwardly by said motor to separate said sheet feeding means from the upper surfaces of the sheet.

7. A sheet feeding apparatus according to claim 1, wherein said motor is a reversible pulse motor rotatably reversely and normally, and a gear train for transmitting rotation of said pulse motor to said holding member is provided, so that said holding member is lifted and lowered by the rotation of said pulse motor transmitted via said gear train.

8. A sheet feeding apparatus according to claim 7, wherein said gear train includes a gear connected to said pulse motor, and a rack meshed with said gear and formed on said holding member, and further comprising means for meshing said rack with said gear to eliminate backlash between said rack and said gear.

9. A sheet feeding apparatus according to claim 8, wherein said biasing means is a spring for biasing said sheet feeding means downwardly to urge said sheet feeding means against the upper surface of the sheet, and said maintaining means is a spring for biasing said holding member upwardly to separate said sheet feeding means from the upper surface of the sheet, and said holding means is biased by said spring for biasing said holding member upwardly to eliminate the backlash between said rack and said gear.

10. A sheet feeding apparatus according to claim 8, further comprising a spring for biasing said holding member to eliminate the backlash between said rack and said gear.

11. An image forming apparatus comprising:

sheet feeding means for abutting against an upper surface of a sheet stacked and feeding out the sheet toward an image forming portion;

biasing means for biasing said sheet feeding means toward the upper surface of the sheet; and lifting and lowering means for lifting and lowering said sheet feeding means;

said lifting and lowering means including a holding member for engaging with said sheet feeding means and shifting said sheet feeding means in an up-and-down direction by a motor, and maintaining means for regulating said holding member so as to maintain said sheet feeding means at a position where said sheet feeding means is spaced apart from the upper surface of the sheet, in opposition to a biasing force of said biasing means.

* * * * *

UNITED STATES PATENT AND TRADEMARK OFFICE

CERTIFICATE OF CORRECTION

PATENT NO. : 6,467,765 B2
DATED : October 22, 2002
INVENTOR(S) : Hiroshi Yukimachi It is certified that error appears in the above-identified patent and that said Letters Patent is hereby corrected as shown below:

Column 1,
Line 54, "stached" should read -- stacked --.

Column 3,
Line 4 "the" (2nd occurrence) should be deleted.

Column 4,
Line 8, "a" (3rd occurrence) should read -- between a --.
Line 19, "a" (3rd occurrence) should read -- between a --.
Line 66, "exciting" should read -- excited --.

Column 5,
Line 30, "to the exciting" should read -- in the excited --.
Line 51, "does" should read -- do --.

Column 6,
Line 10, "to the exciting" should read -- in the excited --.
Line 13, "become" should read -- enter --
Line 20, "generated" should read -- generated at --.
Line 36, "at" should read -- to --.

Signed and Sealed this

Twentieth Day of May, 2003

JAMES E. ROGAN
*Director of the United States Patent and Trademark Office*